US007549514B2

(12) United States Patent
Heggli et al.

(10) Patent No.: US 7,549,514 B2
(45) Date of Patent: Jun. 23, 2009

(54) ELEVATOR FOR LARGE LOADS

(75) Inventors: Mario Heggli, Lucerne (CH); Reto Rothenbühler, Küssnacht (CH); Kaspar Schindler, Unterkulm (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/080,157

(22) Filed: Mar. 15, 2005

(65) Prior Publication Data

US 2005/0217943 A1 Oct. 6, 2005

(30) Foreign Application Priority Data

Mar. 15, 2004 (EP) ..... 04006065

(51) Int. Cl.
*B66B 11/08* (2006.01)

(52) U.S. Cl. ..... 187/266; 187/256

(58) Field of Classification Search ..... 187/266
See application file for complete search history.

(56) References Cited

U.S. PATENT DOCUMENTS

| | | | | |
|---|---|---|---|---|
| 5,833,031 | A * | 11/1998 | Liebetrau et al. | 187/239 |
| 5,878,847 | A * | 3/1999 | Mustalahti et al. | 187/406 |
| 5,899,300 | A * | 5/1999 | Miller et al. | 187/256 |
| 6,035,974 | A * | 3/2000 | Richter et al. | 187/404 |
| 6,471,012 | B2 * | 10/2002 | Faletto | 187/256 |
| 6,598,707 | B2 * | 7/2003 | Nakagaki et al. | 187/256 |
| 6,655,500 | B2 * | 12/2003 | Orrman et al. | 187/254 |
| 6,782,975 | B1 * | 8/2004 | Whittur | 187/240 |
| 6,851,519 | B2 * | 2/2005 | Ach et al. | 187/266 |
| 6,991,069 | B1 * | 1/2006 | Ach | 187/406 |
| 2002/0000348 | A1 | 1/2002 | Faletto | |
| 2002/0125078 | A1 * | 9/2002 | Sasaki | 187/373 |

FOREIGN PATENT DOCUMENTS

| | | |
|---|---|---|
| WO | WO 99/43593 | 9/1999 |
| WO | WO 03/010081 | 2/2003 |
| WO | WO 03/064309 | 8/2003 |

* cited by examiner

*Primary Examiner*—Peter M Cuomo
*Assistant Examiner*—Eric Pico
(74) *Attorney, Agent, or Firm*—Fraser Clemens Martin & Miller LLC; William J. Clemens

(57) ABSTRACT

An elevator with a 4:1 cable guidance includes a drive unit and a first deflecting roller arranged at a carrier supported at one end on a first car guide rail and a first counterweight guide rail and at the other end on a second counterweight guide rail. The guide rails are connected with the shaft wall by means of yokes, whereby the vertical rail forces are conducted into the shaft pit. A drive bracket arranged at the carrier carries the drive unit and the drive pulley. A roller bracket arranged at the carrier carries the first deflecting roller. In addition, a first cable fixing point and a second cable fixing point for opposite ends of a cable are arranged at the carrier. The second deflecting roller is supported on a second car guide rail.

11 Claims, 5 Drawing Sheets

ELEVATOR FOR LARGE LOADS

BACKGROUND OF THE INVENTION

The present invention relates to an elevator for large loads, consisting of an elevator car and a counterweight, wherein the elevator car, which is movable along guide rails, is connected with the counterweight, which is movable along guide rails, by means of a cable guided over a drive pulley and the cable is led from a first cable fixing point to a first deflecting roller of the counterweight, further to a first deflecting roller, further to a second deflecting roller of the counterweight, further to the drive pulley drivable by means of a drive unit, further from the drive pulley to a first deflecting roller pair arranged below the elevator car, further to a second deflecting roller, further to a second deflecting roller pair arranged below the elevator car and further to a second cable fixing point.

Elevator equipment with an elevator car and a counterweight is shown the PCT published specification WO 99/43593, wherein the elevator car is connected with the counterweight by means of a cable guided over a drive pulley. A 4:1 cable guidance with under-looping of the elevator car is provided, wherein for a meter of cable movement at the drive pulley the elevator car or the counterweight moves vertically by a quarter of a meter.

Elevator equipment also is shown in the PCT published specification WO 03/010081 in which the drive unit is supported on a guide rail of the elevator car, on a guide rail of the counterweight and on a support column. In addition, a cross member is provided which is supported at one end at the second guide rail of the counterweight and at the other end at the bracket of the drive unit. The one cable fixing point is arranged at the cross member. This type of equipment is an expensive and disadvantageous solution wherein the drive unit is supported on a support column.

SUMMARY OF THE INVENTION

The present invention avoids the disadvantages of the known equipment and creates an elevator with a 4:1 cable guidance which is simple in construction.

The advantages achieved by the present invention are that no vertical forces are conducted either into the shaft ceiling or into the shaft walls. All components producing vertical forces can be mounted at low cost on existing guide rails. Elevators without an engine room can be made, with the simple construction, even for large loads, wherein the arising forces can be distributed in optimum manner.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
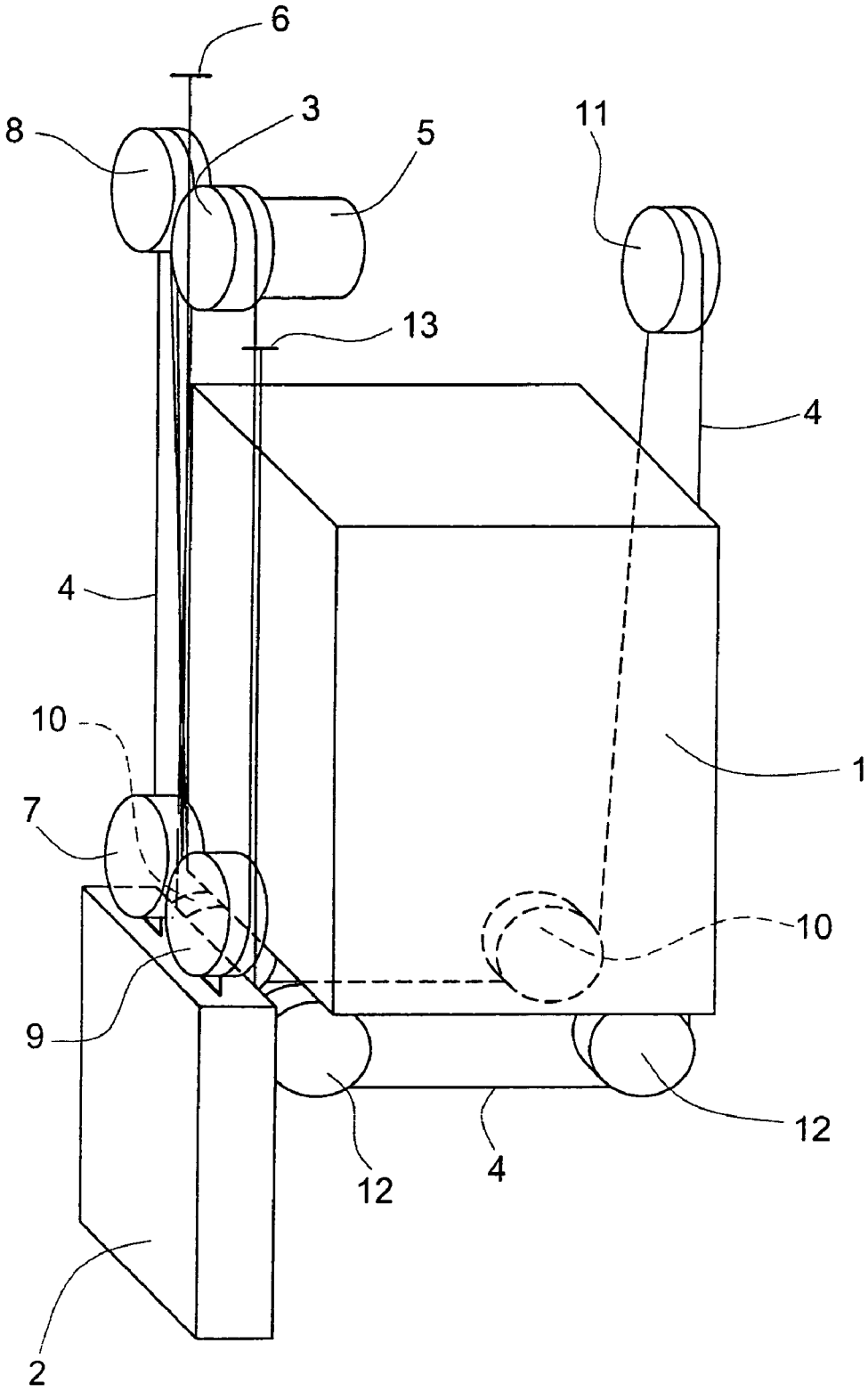
FIG. 1 (PRIOR ART)
FIG. 1 is a schematic perspective view of a prior art elevator with a 4:1 cable guidance.

FIG. 1 shows an elevator, which is known from the state of the art, with an elevator car 1 and a counterweight 2, wherein the elevator car 1 is connected with the counterweight 2 by means of a cable 4 guided over a drive pulley 3. The drive pulley 3 is driven by means of a drive unit 5. A 4:1 cable guidance with under-looping of the elevator car 1 is provided, wherein for a meter of cable movement at the drive pulley 3 the elevator car 1 and the counterweight 2 move vertically by a quarter of a meter.

The cable 4 is led from an upper first cable fixing point 6 to a first deflecting roller 7 of the counterweight 2, further to an upper first deflecting roller 8, further to a second deflecting roller 9 of the counterweight 2, further to the drive pulley 3 arranged at the top of an elevator shaft (not shown) and drivable by means of the drive unit 5, further from the drive pulley 3 to a first deflecting roller pair 10 arranged below the elevator car 1, further to an upper second deflecting roller 11, further to a second deflecting roller pair 12 arranged below the elevator car 1 and further to an upper second cable fixing point 13.

Figure 2:
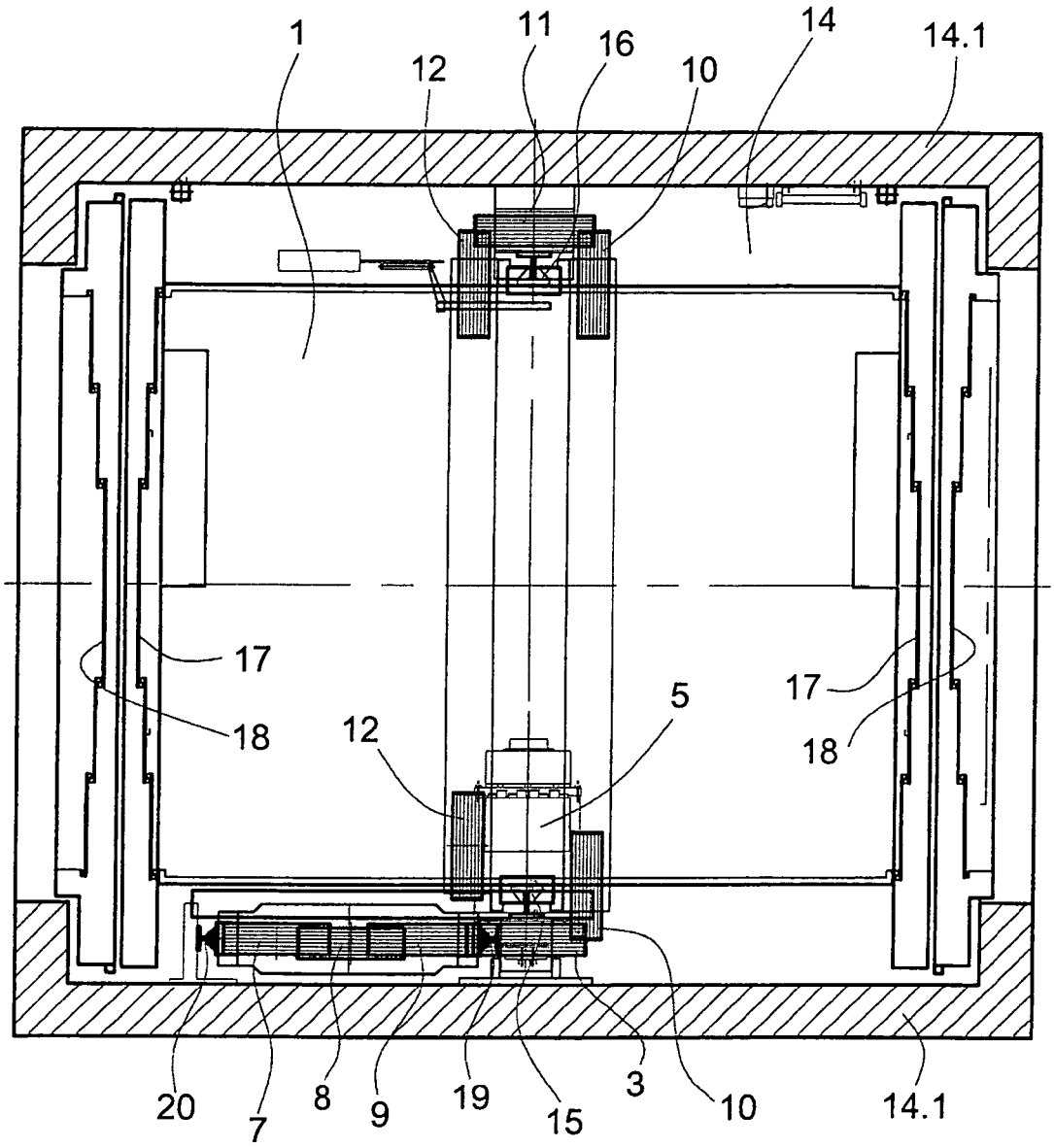
FIG. 2 is a cross-sectional top plan view of the elevator according to the present invention with a 4:1 cable guidance.
Figure 4:
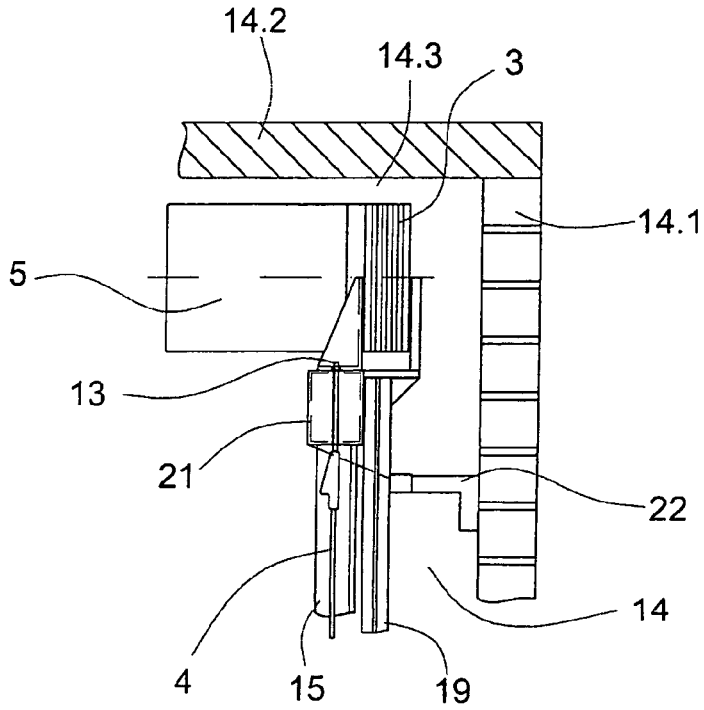
FIG. 4 is a fragmentary cross-sectional elevation view of the drive unit shown in FIG. 2.

FIG. 2 is a plan view of an elevator according to the present invention with a 4:1 cable guidance. The elevator car 1 movable in an elevator shaft 14 along a first car guide rail 15 and a second car guide rail 16 has at least one car sliding door 17, which co-operates by means of a door drive (not illustrated) with a floor door 18. The counterweight 2 is movable along a first counterweight guide rail 19 and along a second counterweight guide rail 20 in the elevator shaft 14, which is bounded by shaft walls 14.1 and a shaft ceiling 14.2 (FIG. 4). The uppermost part of the elevator shaft 14 is termed a shaft head 14.3 (FIG. 4). The cable 4 is constructed as a cable run with several cables guided in parallel. For the sake simplicity the term "cable" is further used. A flat belt can also be provided instead of the cable 4. In correspondence with the number of cables or flat belts the deflecting rollers 7, 8, 9, 10, 11, 12 and the drive pulley 3 have grooves. The drive unit 5 can comprise, for example, an asynchronous motor or a synchronous motor with permanent magnets.

The arrangement of the deflecting rollers 7, 8, 9, 10, 11, 12, the drive pulley 3 and the drive unit 5 is apparent from the plan view of FIG. 2, wherein the longitudinal axis of the drive unit 5 together with the drive pulley 3 extends perpendicularly to the shaft wall at which at least the guide rails 19, 20 of the counterweight 2 are arranged.

Figure 3:
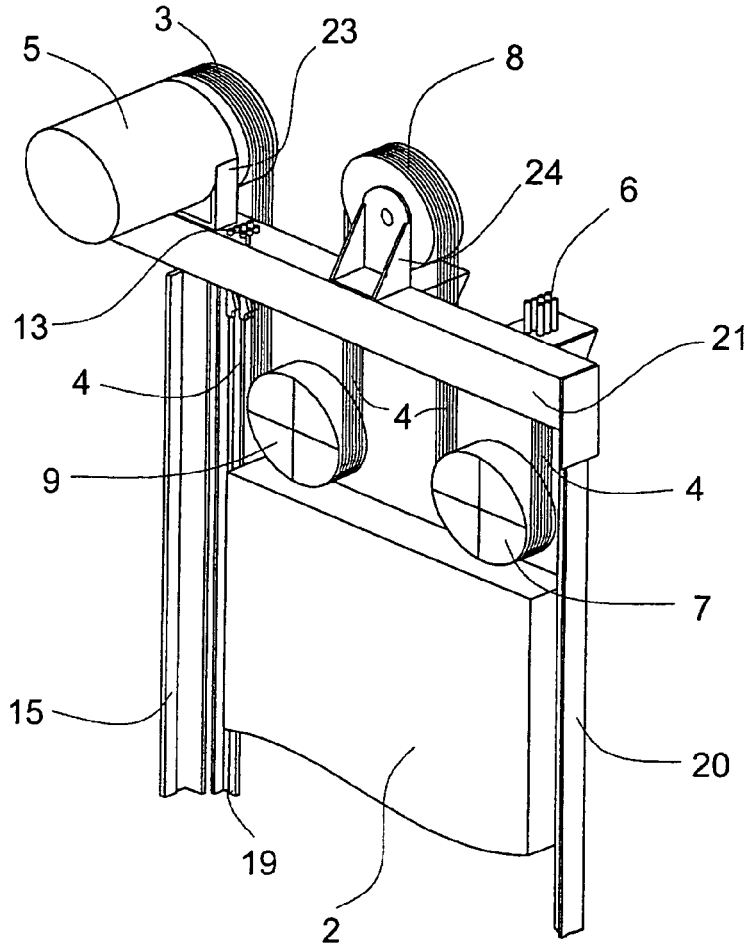
FIG. 3 is a schematic perspective view of the arrangement of the drive unit and deflecting rollers shown in FIG. 2.

FIG. 3 and FIG. 4 show details of the arrangement of the drive unit 5 and the upper first deflecting roller 8 of the elevator according to the present invention. A carrier 21 is supported at one end on the first car guide rail 15 and the first counterweight guide rail 19 and at the other end on the second counterweight guide rail 20. The guide rails are connected with the shaft wall 14.1 by means of yokes 22, whereby the vertical rail forces are conducted into the shaft pit. A drive bracket 23 arranged at the carrier 21 carries the drive unit 5 and the drive pulley 3. A roller bracket 24 arranged at the carrier 21 carries the upper first deflecting roller 8. In addition, the upper first cable fixing point 6 and the upper second cable fixing point 13 are arranged at the carrier 21.

Figure 5:
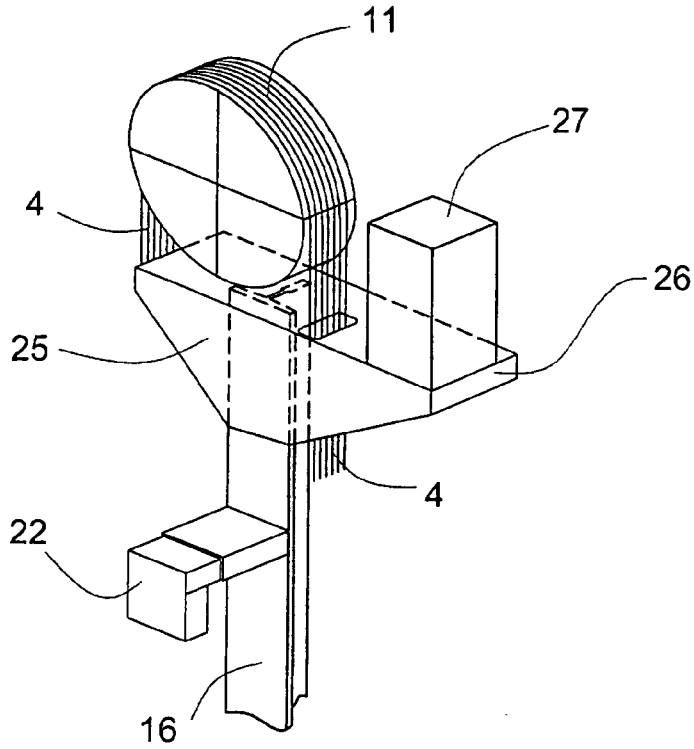
FIG. 5 is a schematic perspective view of a second deflecting roller shown in FIG. 2.
Figure 6:
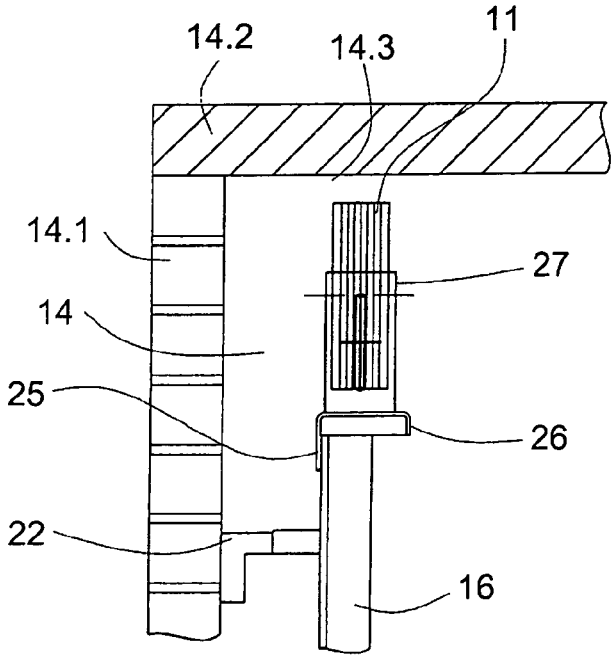
FIG. 6 is a fragmentary cross-sectional elevation view of the deflecting roller shown in FIG. 2.

FIG. 5 and FIG. 6 show details of the arrangement of the upper second deflecting roller 11 of the elevator according to the present invention. A roller bracket 25 is supported on the second car guide rail 16 and carries the upper second deflecting roller 11. The roller bracket 25 comprises an arm 26, on which a speed limiter 27 can be mounted. The guide rail 11 is connected by means of yokes 22 with the shaft wall 14.1, whereby the vertical rail forces are conducted into the shaft pit.

Figure 7:
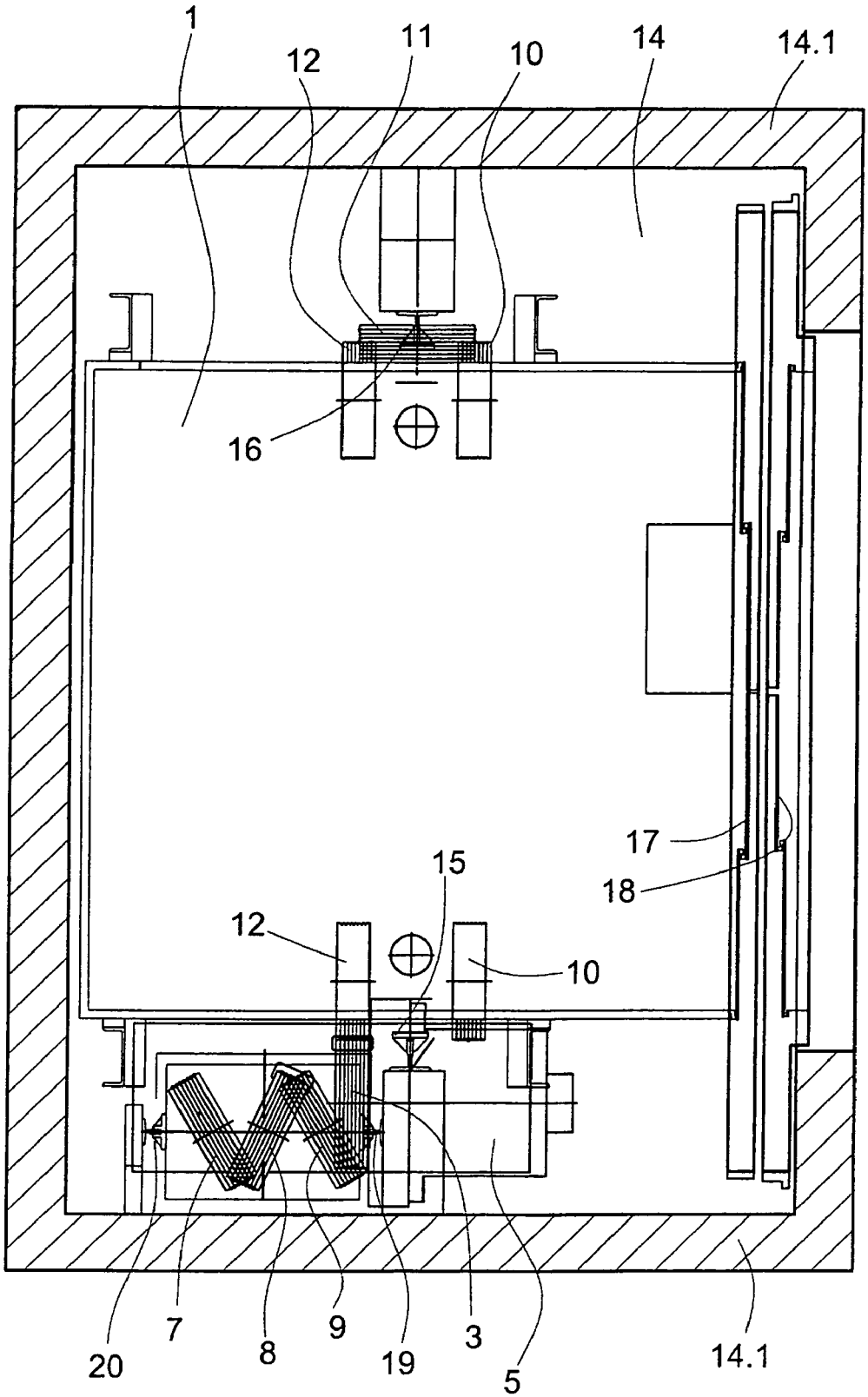
FIG. 7 is a cross-sectional top plan view of an alternate embodiment of the elevator according to the present invention.

FIG. 7 shows a constructional variant of the arrangement of the drive unit 5 with the drive pulley 3. The longitudinal axis of the drive unit 5 together with the drive pulley 3 extends parallel to the shaft wall at which at least the guide rails 19, 20 of the counterweight 2 are arranged. The deflecting rollers 7, 9 of the counterweight 2 and the deflecting roller 8 of the carrier 21 are arranged at an angle to the longitudinal axis of the drive unit. The cable fixing points 6, 13 are again arranged at the carrier 21.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator for large loads including an elevator car connected to a counterweight by a cable guided over a drive pulley drivable by a drive unit, the elevator car and the counterweight being movable in an elevator shaft along associated guide rails, the cable being fixed at one end at a first cable fixing point in the elevator shaft and being fixed at an opposite end to a second cable fixing point in the elevator shaft, comprising:

a first deflecting roller and a second deflecting roller attached to the counterweight;

an upper first deflecting roller;

a first deflecting roller pair arranged below the elevator car;

an upper second deflecting roller;

a second deflecting roller pair arranged below the elevator car, wherein the cable extends from the first cable fixing point to said first deflecting roller of the counterweight, further to said upper first deflecting roller, further to said second deflecting roller of the counterweight, further to the drive pulley, further to said first deflecting roller pair, further to said upper second deflecting roller, further to said second deflecting roller pair, and to the second cable fixing point; and a carrier at which the drive unit, said upper first deflecting roller and the first and second cable fixing points are arranged, said carrier being supported at one end on a car guide rail and a first counterweight guide rail and being supported at another end only by a second counterweight guide rail, said car guide rail and said first counterweight guide rail being positioned adjacent one another at said one end of said carrier, wherein said car guide rail abuts underneath said carrier, whereby said car guide rail, said first counterweight guide rail and said second counterweight guide rail are the only support of said carrier along an entire length of said carrier, said drive unit being positioned entirely above said car guide rail and said first counterweight guide rail.

2. The elevator according to claim 1 wherein said upper second deflecting roller is arranged at a roller bracket which is adapted to be attached to one of the guide rails.

3. The elevator according to claim 2 wherein said roller bracket includes an arm adapted to mount a speed limiter.

4. The elevator according to claim 1 wherein a longitudinal axis of the drive unit and the drive pulley extends perpendicularly to a shaft wall at which at least the guide rails for the counterweight are arranged.

5. The elevator according to claim 1 wherein a longitudinal axis of the drive unit and the drive pulley extends parallel to a shaft wall at which at least the guide rails for the counterweight are arranged.

6. An elevator for large loads comprising:

an elevator car connected to a counterweight by a cable and movable in an elevator shaft;

a drive unit driving a drive pulley engaging said cable;

a plurality of guide rails mounted in the elevator shaft along which said elevator car and said counterweight move;

a first deflecting roller and a second deflecting roller attached to said counterweight;

an upper first deflecting roller;

a first deflecting roller pair arranged below the elevator car;

an upper second deflecting roller;

a second deflecting roller pair arranged below the elevator car, wherein the cable extends from a first cable fixing point to said first deflecting roller of said counterweight, further to said upper first deflecting roller, further to said second deflecting roller of said counterweight, further to said drive pulley, further to said first deflecting roller pair, further to said upper second deflecting roller, further to said second deflecting roller pair, and to a second cable fixing point; and a carrier at which said drive unit, said upper first deflecting roller and said first and second cable fixing points are arranged, said carrier being supported at one end on a first car guide rail of said guide rails and a first counterweight guide rail of said guide rails and being supported at another end only by a second counterweight guide rail of said guide rails, said first car guide rail and said first counterweight guide rail being positioned adjacent one another at said one end of said carrier, wherein said car guide rail abuts underneath said carrier, whereby said first car guide rail, said first counterweight guide rail and said second counterweight guide rail are the only support of said carrier along an entire length of said carrier.

7. The elevator according to claim 6 wherein said upper second deflecting roller is mounted at a roller bracket attached to one of said guide rails.

8. The elevator according to claim 7 wherein said roller bracket includes an arm adapted to mount a speed limiter.

9. The elevator according to claim 6 wherein a longitudinal axis of said drive unit and said drive pulley extends perpendicularly to a shaft wall at which at least said guide rails for said counterweight are arranged.

10. The elevator according to claim 6 wherein a longitudinal axis of said drive unit and said drive pulley extends parallel to a shaft wall at which at least said guide rails for said counterweight are arranged.

11. An elevator for large loads including an elevator car connected to a counterweight by a cable guided over a drive pulley drivable by a drive unit, the elevator car and the counterweight being movable in an elevator shaft along associated guide rails, the cable being fixed at one end at a first cable fixing point in the elevator shaft and being fixed at an opposite end to a second cable fixing point in the elevator shaft, comprising:

a first deflecting roller and a second deflecting roller attached to the counterweight;

an upper first deflecting roller;

a first deflecting roller pair arranged below the elevator car;

an upper second deflecting roller;

a second deflecting roller pair arranged below the elevator car, wherein the cable extends from the first cable fixing point to said first deflecting roller of the counterweight, further to said upper first deflecting roller, further to said second deflecting roller of the counterweight, further to the drive pulley, further to said first deflecting roller pair, further to said upper second deflecting roller, further to said second deflecting roller pair, and to the second cable fixing point; and a carrier at which the drive unit, said upper first deflecting roller and the first and second cable fixing points are arranged wherein said carrier is supported at one end by one of said guide rails for the elevator car and one of said guide rails for the counterweight and is supported at an opposite end only by another one of said guide rails for the counterweight, said one car guide rail and said one guide rail for the counterweight being positioned adjacent one another at said one end of said carrier, wherein said car guide rail abuts underneath said carrier, whereby said one of said car guide rails, said one of said guide rails for the counterweight and said another one of said guide rails for the counterweight are the only support of said carrier along an entire length of said carrier.

* * * * *